US009554217B2

(12) United States Patent
Galster

(10) Patent No.: US 9,554,217 B2
(45) Date of Patent: Jan. 24, 2017

(54) COMPRESSOR ARCHITECTURE FOR AVOIDANCE OF CROSS-MODULATION IN REMOTE MICROPHONES

(71) Applicant: Starkey Laboratories, Inc., Eden Prairie, MN (US)

(72) Inventor: Jason Alan Galster, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 185 days.

(21) Appl. No.: 14/525,772

(22) Filed: Oct. 28, 2014

(65) Prior Publication Data

US 2016/0119723 A1 Apr. 28, 2016

(51) Int. Cl.
*H04R 25/00* (2006.01)

(52) U.S. Cl.
CPC ..... *H04R 25/453* (2013.01); *H04R 25/407* (2013.01); *H04R 25/505* (2013.01); *H04R 25/554* (2013.01); *H04R 25/558* (2013.01); *H04R 25/356* (2013.01); *H04R 2225/43* (2013.01); *H04R 2225/55* (2013.01); *H04R 2460/03* (2013.01)

(58) Field of Classification Search
CPC ..... H04R 3/005; H04R 25/356; H04R 25/407; H04R 25/453; H04R 25/505; H04R 25/554; H04R 25/558; H04R 25/70; H04R 2225/41; H04R 2225/43; H04R 2430/03; H04R 2225/55; H04R 2460/03
USPC ..... 381/310, 57, 60, 312, 315, 317, 320, 321,381/94.1, 94.3, 98, 104, 23.1; 600/559; 73/585
See application file for complete search history.

(56) References Cited

U.S. PATENT DOCUMENTS 4,680,798 A * 7/1987 Neumann ..... H04R 25/505 381/104
5,303,306 A * 4/1994 Brillhart ..... H04R 25/558 381/312
7,940,945 B2 5/2011 Callias et al.
8,315,400 B2 * 11/2012 Goldstein ..... H04R 3/005 381/317
2009/0041260 A1 2/2009 Jorgensen et al.
(Continued)

FOREIGN PATENT DOCUMENTS

EP 1773099 A1 4/2007
EP 1863320 B1 12/2007
(Continued)

OTHER PUBLICATIONS

"European Application Serial No. 15191872.9, Extended European Search Report mailed Feb. 26, 2016", 7 pgs.

*Primary Examiner* — Huyen D Le
(74) *Attorney, Agent, or Firm* — Schwegman Lundberg & Woessner, P.A.

(57) ABSTRACT

The present disclosure relates to the inclusion of amplitude compression inside a hearing aid remote microphone or audio streaming device. Compressor design is improved by using one local and one remote compressor operating in parallel. The subject matter will reference remote microphones as the primary use case. In one embodiment, hearing aid microphone audio and remote microphone audio are treated as two separate streams within the hearing aid, assigning each to a compressor and mixing the audio streams afterward. In another embodiment, a compressor is developed for the remote microphone to offload that portion of the signal processing.

32 Claims, 6 Drawing Sheets

(56) References Cited

U.S. PATENT DOCUMENTS

| | | | |
|---|---|---|---|
| 2009/0296944 | A1 | 12/2009 | Edwards |
| 2013/0108096 | A1 | 5/2013 | Fitz |
| 2013/0182876 | A1 | 7/2013 | Mulder et al. |

FOREIGN PATENT DOCUMENTS

| | | | |
|---|---|---|---|
| EP | 2103177 | B1 | 9/2009 |
| EP | 2131610 | B1 | 12/2009 |
| EP | 2617127 | A2 | 7/2013 |
| WO | WO 2009049645 | A1 | 4/2009 |
| WO | WO-2014094858 | A1 | 6/2014 |

* cited by examiner

COMPRESSOR ARCHITECTURE FOR AVOIDANCE OF CROSS-MODULATION IN REMOTE MICROPHONES

FIELD OF THE INVENTION

This patent application pertains to apparatus and processes for avoidance of cross-modulation in hearing assistance devices.

BACKGROUND

Modern hearing assistance devices typically include digital electronics to enhance the wearer's experience. Whether due to a conduction deficit or sensorineural damage, hearing loss in most patients occurs non-uniformly over the audio frequency range, most commonly at high frequencies. Hearing aids may be designed to compensate for such hearing deficits by amplifying received sound in a frequency-specific manner, thus acting as a kind of acoustic equalizer that compensates for the abnormal frequency response of the impaired ear. Adjusting a hearing aid's frequency-specific amplification characteristics to achieve a desired level of compensation for an individual patient is referred to as fitting the hearing aid. One common way of fitting a hearing aid is to measure hearing loss, apply a fitting algorithm, and fine-tune the hearing aid parameters.

Hearing assistance devices also use a dynamic range adjustment, called dynamic range compression, which controls the level of sound sent to the ear of the patient to normalize the loudness of sound in specific frequency regions. The gain that is provided at a given frequency is controlled by the level of sound in that frequency region (the amount of frequency specificity is determined by the filters in the multiband compression design). When properly used, compression adjusts the level of a sound at a given frequency such that its loudness is similar to that for a normal hearing person without a hearing aid. There are other fitting philosophies, but they all prescribe a certain gain for a certain input level at each frequency. It is well known that the application of the prescribed gain for a given input level is affected by time constants of the compressor. What is less well understood is that the prescription can break down when there are two or more simultaneous sounds in the same frequency region. The two sounds may be at two different levels, and therefore each should receive different gain for each to be perceived at their own necessary loudness. Because only one gain value can be prescribed by the hearing aid, however, at most one sound can receive the appropriate gain, providing the second sound with the less than desired sound level and resulting loudness.

Current hearing aid designs employ digital signal processors rich in features. The operation and maintenance of wireless hearing aids may be improved or simplified by improving the wireless communication components within the hearing aid. Some wireless hearing aids have sought to improve wireless performance by using various wireless protocols, error concealment, or data encoding within a radio frequency (RF) band to improve link quality. However, these solutions have been limited by RF congestion within an RF band, causing lower data rates and unreliable communication. The use of multiple RF bands (e.g., multi-band operation) may be complicated by the various frequencies available in different countries. Additionally, the amount of absorption of radio signals in typical user environments changes significantly with frequency of the signals. Furthermore, communications at different frequencies can require substantially different electronics in various cases.

What is needed in the art is an improved method of wireless communications between hearing assistance devices.

SUMMARY

Disclosed herein, among other things, are methods and apparatus for hearing assistance devices, including but not limited to hearing aids, and in particular to avoidance of cross-modulation in hearing assistance devices.

This application proposes the inclusion of amplitude compression inside a hearing aid remote microphone or audio streaming device. The compressor design is improved by using one local and one remote compressor operating in parallel. The subject matter will reference remote microphones as the primary use case.

In current applications, the hearing aid compressor acts on both the hearing aid microphone input and the audio that is wirelessly streamed from a remote microphone to an intermediate hearing accessory device or to a hearing aid. It is the case that the louder of the two audio streams will dominate the level estimate at the compressor, which may cause the hearing aid to assign gains that may not be appropriate for the lower level signal. Thus, the two signals are modulated as one, rather than being discretely analyzed and amplified. Audio input to a remote microphone will often be cleaner than that at the hearing aid microphone. Analysis and amplification of the cleaner speech signal may result in improved speech audibility and understanding in background noise.

There are at least two opportunities for implementation. The first would be to treat the hearing aid microphone audio and remote microphone audio as two separate streams within the hearing aid, assigning each to a compressor and mixing the audio streams afterward. A second application would be to develop a compressor for the remote microphone and offload that portion of the signal processing. In this second case, there would be a requirement for the hearing aid to transmit the hearing loss specific prescribed gains to the remote microphone.

This Summary is an overview of some of the teachings of the present application and not intended to be an exclusive or exhaustive treatment of the present subject matter. Further details about the present subject matter are found in the detailed description and appended claims. The scope of the present application is defined by the appended claims and their legal equivalents.

DETAILED DESCRIPTION

Disclosed herein, among other things, are methods and apparatuses for avoidance of cross-modulation in hearing assistance devices.

Various features arise from processing an audio signal at a remote device. When no processing occurs at a remote device, a transmitted audio signal may include the desired audio signal and unwanted noise. Many hearing assistance radios apply a form of compression to reduce processing and power consumption. When no processing occurs at a remote device, compressing the remote audio signal may include compressed, unwanted noise. Additionally, depending on the type of compression used, a desired audio signal may be compressed disproportionate to unwanted noise. By processing an audio signal at a remote device, the desired audio signal may be isolated or amplified, and unwanted noise may be attenuated. This may improve the audio clarity of the transmitted audio signal. Similarly, by reducing or removing unwanted noise or frequency bands, the RF radios may transmit the desired audio signal at reduced bit rate or using reduced power consumption.

Figure 1:
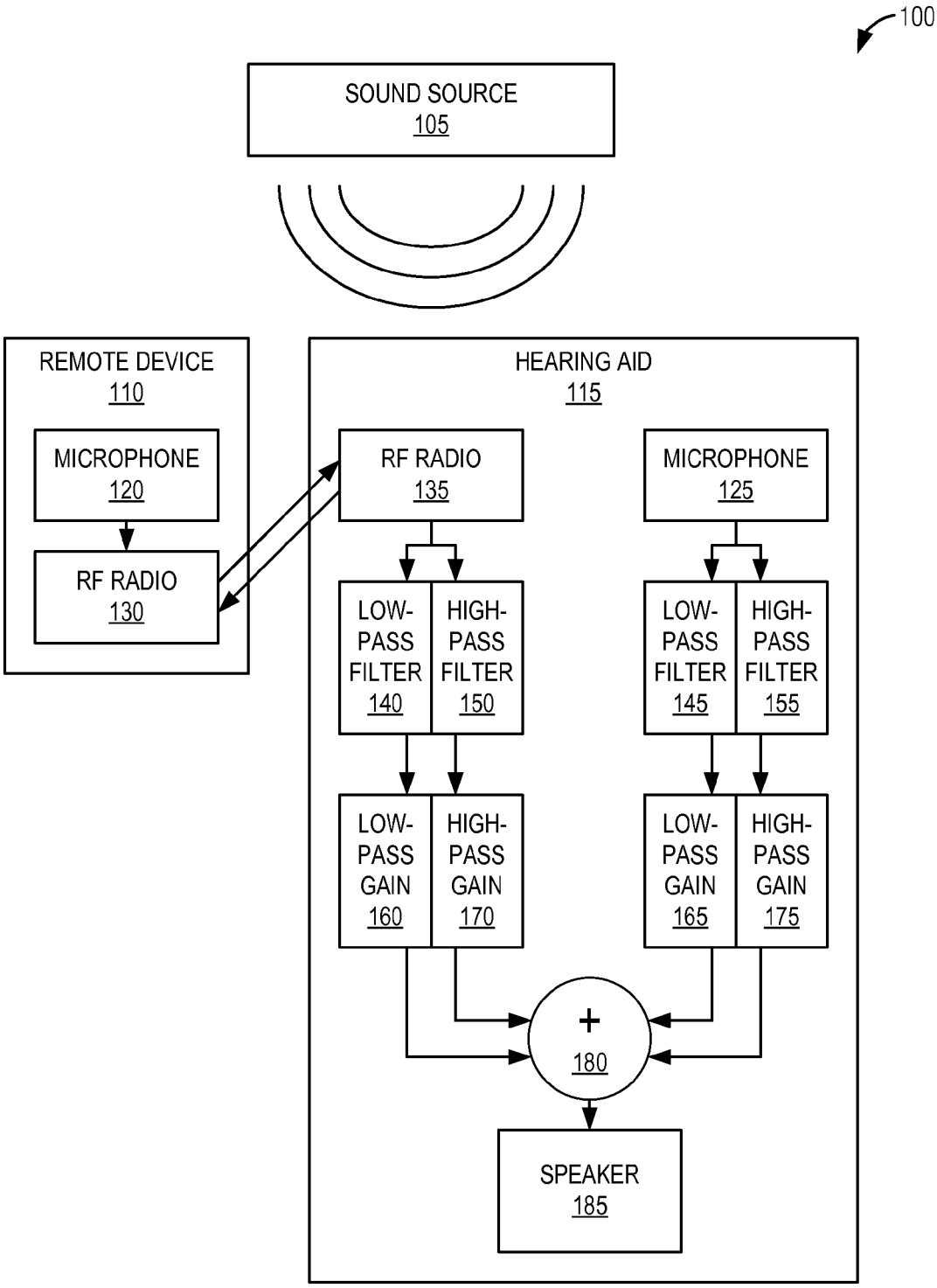
FIG. 1 shows a first example compressor design for avoidance of cross-modulation in remote microphones.

FIG. 1 shows a first example compressor design for avoidance of cross-modulation in remote microphones. A sound may propagate from a sound source 105 to a remote device 110 and to a hearing aid 115. The sound may be transduced into an audio signal by a remote device microphone 120 and by a hearing aid microphone 130. The audio signal may be transmitted from the remote device RF radio 130 to the hearing aid RF radio 135. The audio signal may be passed through one or more filters to separate the signal into various frequency components. For example, the audio signal may be passed through low-pass filters 140 and 145 to isolate lower frequencies within the audio signal. Similarly, the audio signal may be passed through high-pass filters 150 and 155 to isolate higher frequencies within the audio signal. The isolated lower frequencies may be passed through low-pass gain amplifiers 160 and 165, and the isolated higher frequencies may be passed through high-pass gain amplifiers 170 and 175. The filters and amplifiers may be implemented using separate hardware or software modules, or the filters and amplifiers may be implemented together within a hardware or software filterbank. The amplified signals may be combined at a signal adder 180 and output to a user through a speaker 185.

Though FIG. 1 depicts separate channels for the low-pass and high-pass filters and amplifiers, any number of frequency channels may be used. For example, multiple band-pass filters may be used to isolate various frequency bands, and each isolated frequency band may have a dedicated amplifier. Each filter may have an associated amplifier, where the associated amplifier amplifies the isolated frequency band according to the needs of the hearing aid user. For example, a user exhibiting hearing loss at speech frequencies may have a positive gain applied to the frequency band corresponding to speech frequencies, and may have a negative gain applied to frequency bands below and above speech frequencies. Though FIG. 1 depicts an amplifier associated with each filter, multiple amplifiers may be used for a single filter, or multiple filters may pass signals through a single amplifier. For example, a single amplifier may be used to amplify multiple signals simultaneously, or multiple signals may be multiplexed through a single amplifier.

Figure 2:
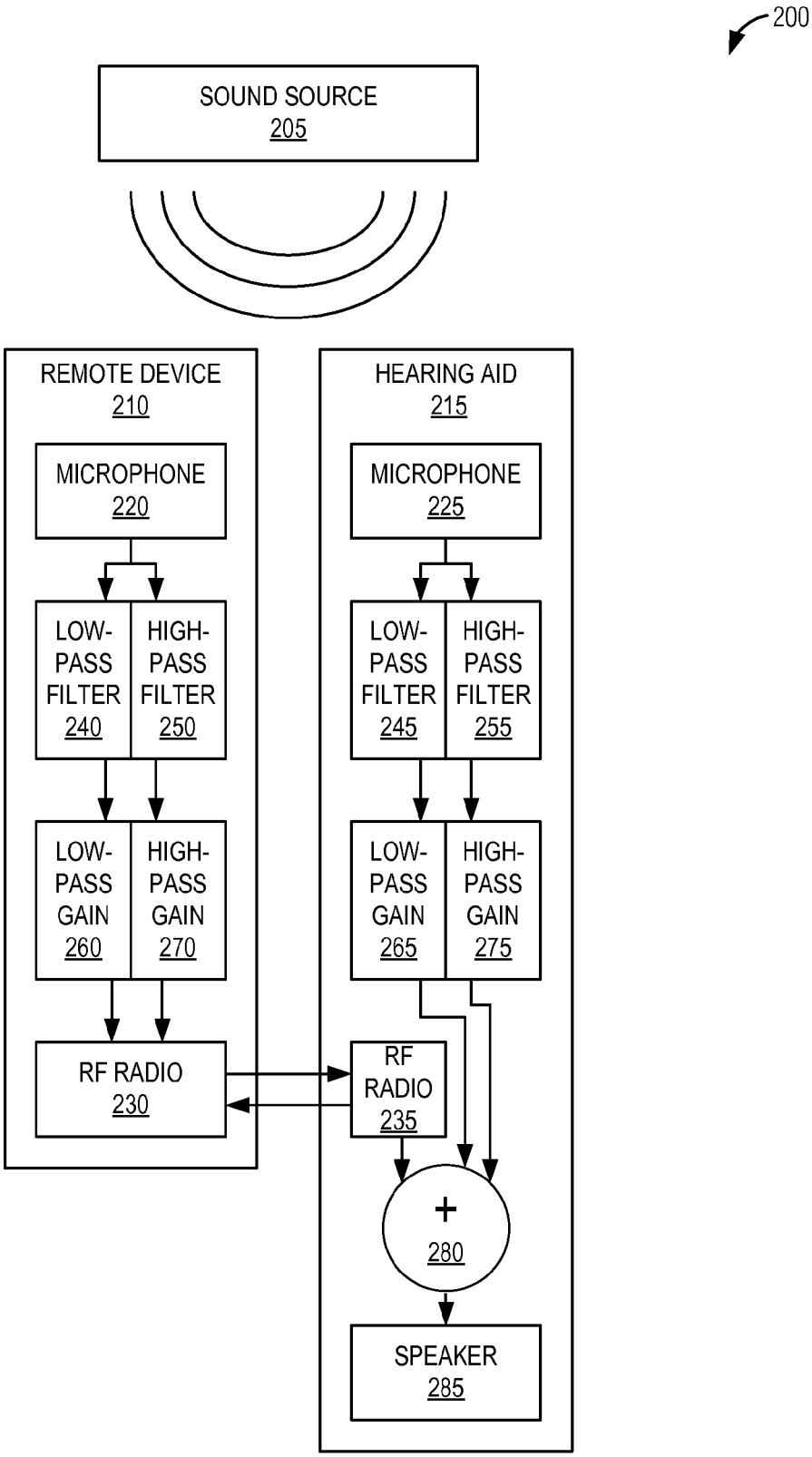
FIG. 2 shows a second example compressor design for avoidance of cross-modulation in remote microphones.

FIG. 2 shows a second example compressor design for avoidance of cross-modulation in remote microphones. A sound may propagate from a sound source 205 to a remote device 210 and to a hearing aid 215. The sound may be transduced into an audio signal by a remote device microphone 220 and by a hearing aid microphone 230. The audio signal may be passed through one or more filters to separate the signal into various frequency components. For example, the audio signal may be passed through low-pass filters 240 and 245 to isolate lower frequencies within the audio signal. Similarly, the audio signal may be passed through high-pass filters 250 and 255 to isolate higher frequencies within the audio signal. The isolated lower frequencies may be passed through low-pass gain amplifiers 260 and 265, and the isolated higher frequencies may be passed through high-pass gain amplifiers 270 and 275. The filtered and amplified audio signal may be transmitted from the remote device RF radio 230 to the hearing aid RF radio 235. The amplified signals may be combined at a signal adder 280 and output to a user through a speaker 285.

The RF radios 230 or 235 may be used to update the filters 240, 245, 250, or 255 or the amplifiers 260, 265, 270, or 275. For example, an audiologist may use an external device to characterize the hearing loss profile of a user, and then use an external programming device to adjust various filter characteristics, such as the frequencies attenuated by the filters 240, 245, 250, or 255, or to adjust the dB per octave rate at which the frequencies are attenuated. Similarly, an external programming device may be used to adjust the gain that amplifiers 260, 265, 270, or 275 apply to the various frequency bands. The RF radios 230 or 235 may receive one or more of these parameters as inputs, as described more fully with respect to FIG. 5 below.

The filters 240, 245, 250, or 255 or the amplifiers 260, 265, 270, or 275 may be configured using a hardwired connection to an external programming device, or may be configured to receive configuration changes through the RF radios 230 or 235 using a wireless external programming device. A wireless external programming device may be used to communicate to hearing aid 215 through RF radio 235, and the hearing aid 215 may convey the filter or amplifier configuration through RF radio 235 to the remote device 210 using remote device RF radio 230. Conveying configuration information from the hearing aid 215 to the remote device 210 may be useful when the connection path between the external programming device is different from the path between the RF radios 230 and 235. For example, the external programming device may be connected to the hearing aid 215 using 802.11, and the RF radios 230 and 235 may be connected using Bluetooth. Alternatively, the hearing aid 215 may include a wired or wireless internet connection for remote programming, and may use RF radios 230 and 235 to convey the configuration information to the remote device 210. Even if the RF radios 230 and 235 use the same protocol, if the external programming device is separated by a distance that inhibits communication, the hearing aid 215 may relay the information to the remote device 210. The relay of configuration partners is also described below with respect to FIG. 5.

The RF radios 230 and 235 may also be used to detect and compensate for unwanted noise. For example, the hearing aid 215 may detect excessive unwanted noise in a particular frequency band and send configuration information to the remote device 210 to filter specific frequencies to attenuate the unwanted noise. Similarly, the hearing aid 215 may convey all audio information to the remote device 210, the remote device 210 may compare the received audio information with audio information received at the remote device microphone 220, and may alter its filter or amplifier configuration to compensate for the unwanted noise. Detection and compensation for unwanted noise is also described below with respect to FIG. 6.

Figure 3:
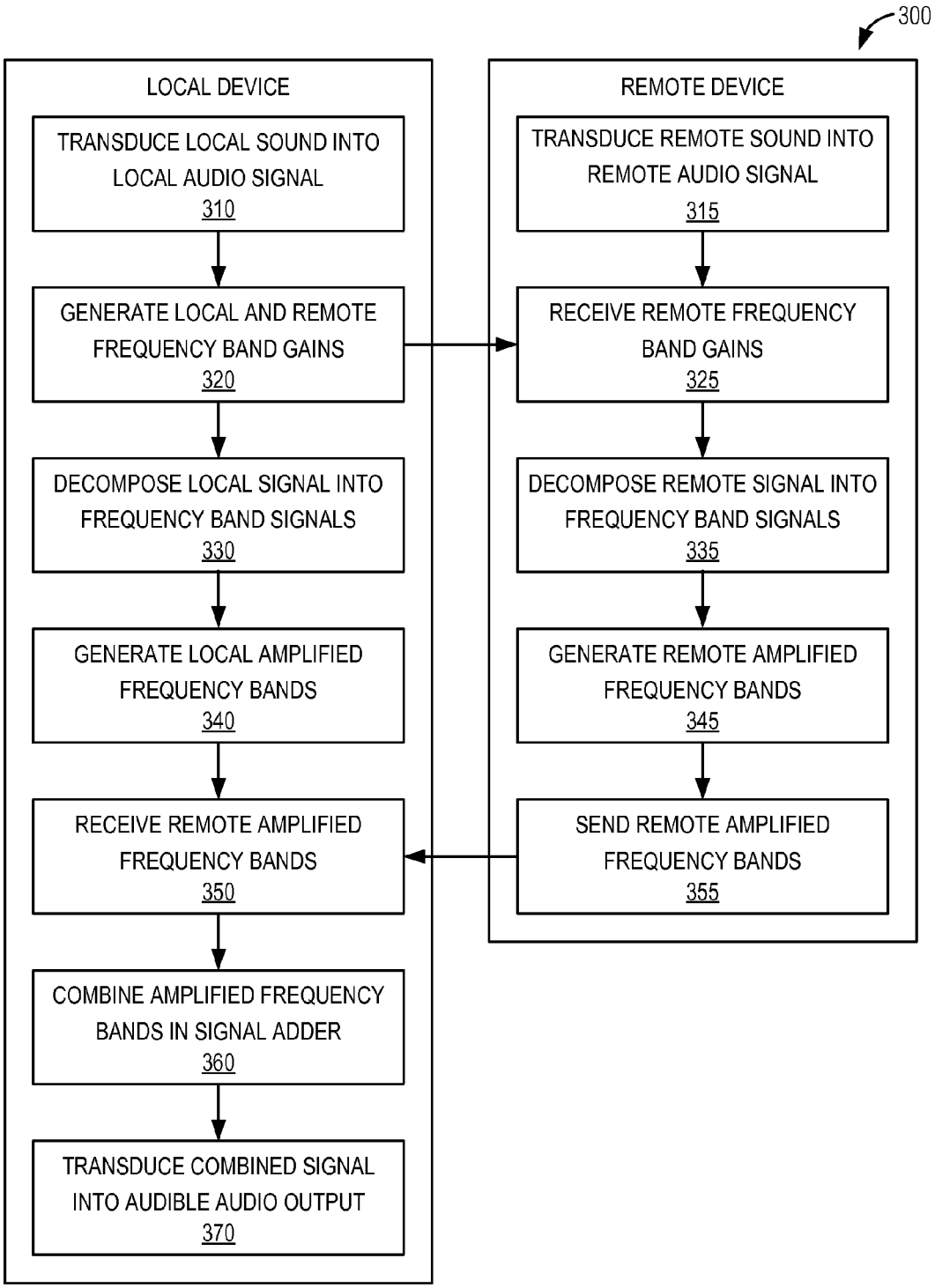
FIG. 3 shows a method of avoiding cross-modulation in remote microphones.

FIG. 3 shows a method 300 of avoiding cross-modulation in remote microphones. Method 300 may include using a local hearing assistance device microphone to transduce 310 a local sound source into a local audio signal. Similarly, method 300 may include using a remote hearing assistance device microphone to transduce 315 a remote sound source into a remote audio signal. Using the local and remote audio signals, method 300 may include generating 320 local and remote frequency band gains, as shown and discussed in FIG. 4 and accompanying text. The remote frequency gains may be sent to and received 325 by the remote hearing assistance device. At the local hearing assistance device, the received local audio signal may be decomposed 330 into local frequency band signals. The local frequency band gains may be applied to the local frequency band signals to generate 340 local amplified frequency bands. In parallel with the generation of local amplified frequency bands, the remote device may use remote frequency band gains to generate remote amplified frequency bands. The remote hearing assistance device may be configured to decompose 335 the remote audio signal into remote frequency band signals. The remote hearing assistance device may apply the remote frequency band gains to the remote frequency band signals to generate 345 remote amplified frequency bands.

The local or remote amplified frequency bands may correspond to a hearing loss profile of a hearing assistance user and to the local or remote noise environment, respectively. The hearing loss profile may be generated by applying a hearing loss characterization test to generate hearing loss characterization results, where the hearing loss characterization results may be used by an audiologist or automated program to generate the hearing loss profile of the hearing assistance user. Applying the local or remote frequency band gains to the local or remote frequency band signals includes applying a positive gain to a frequency band corresponding to speech frequencies to improve intelligibility. The application of frequency band gains to the frequency bands may be performed in parallel or in series. For example, a series application may include multiplexing the frequency band signals through a local or remote multiplexed signal amplifier.

Once generated, the remote amplified frequency bands may be sent 355 from the remote hearing assistance device and received 350 by the local hearing assistance device. The local hearing assistance device may use a signal adder to combine 360 the local amplified frequency bands with the remote amplified frequency bands to generate a combined amplified audio output signal. The local hearing assistance device may use a local speaker to transduce 370 the combined amplified audio output signal into an audible audio output.

Figure 4:
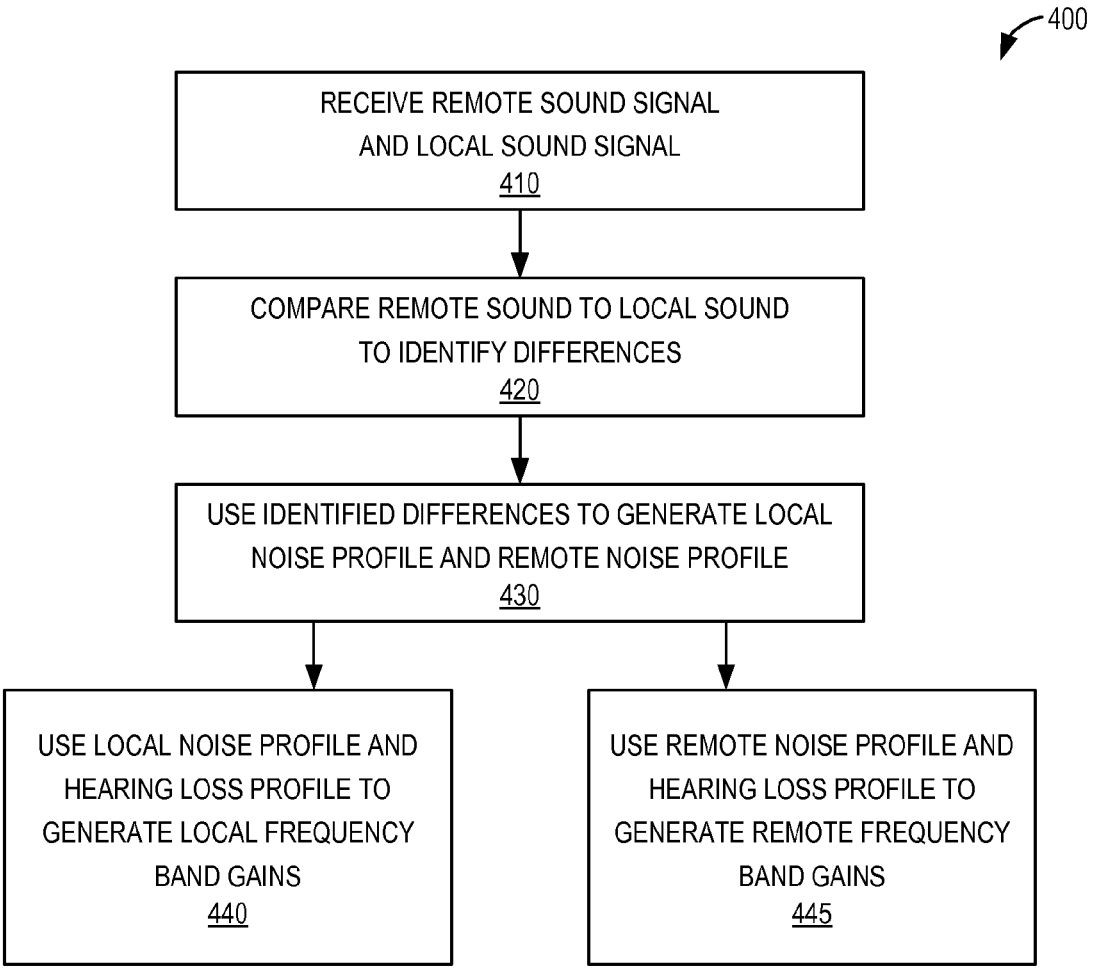
FIG. 4 shows a method of generating local and remote frequency band gains.

FIG. 4 shows a method 400 of generating local and remote frequency band gains. Method 400 frequency band gains may include receiving 410 a remote sound signal and a local sound signal, where at least a portion of the local audio signal is different from at least a portion of the remote audio signal. The remote sound signal may be compared 420 and the local sound signal. This comparison identifies differences between the remote sound signal and the local sound signal. The identified differences may be used to generate 430 a local speech and noise profile and a remote speech and noise profile. The local speech and noise profile and the hearing loss profile of the hearing assistance user may be used to generate 440 the local frequency band gains. The remote speech and noise profile and the hearing loss profile of the hearing assistance user may be used to generate 445 the remote frequency band gains.

Figure 5:
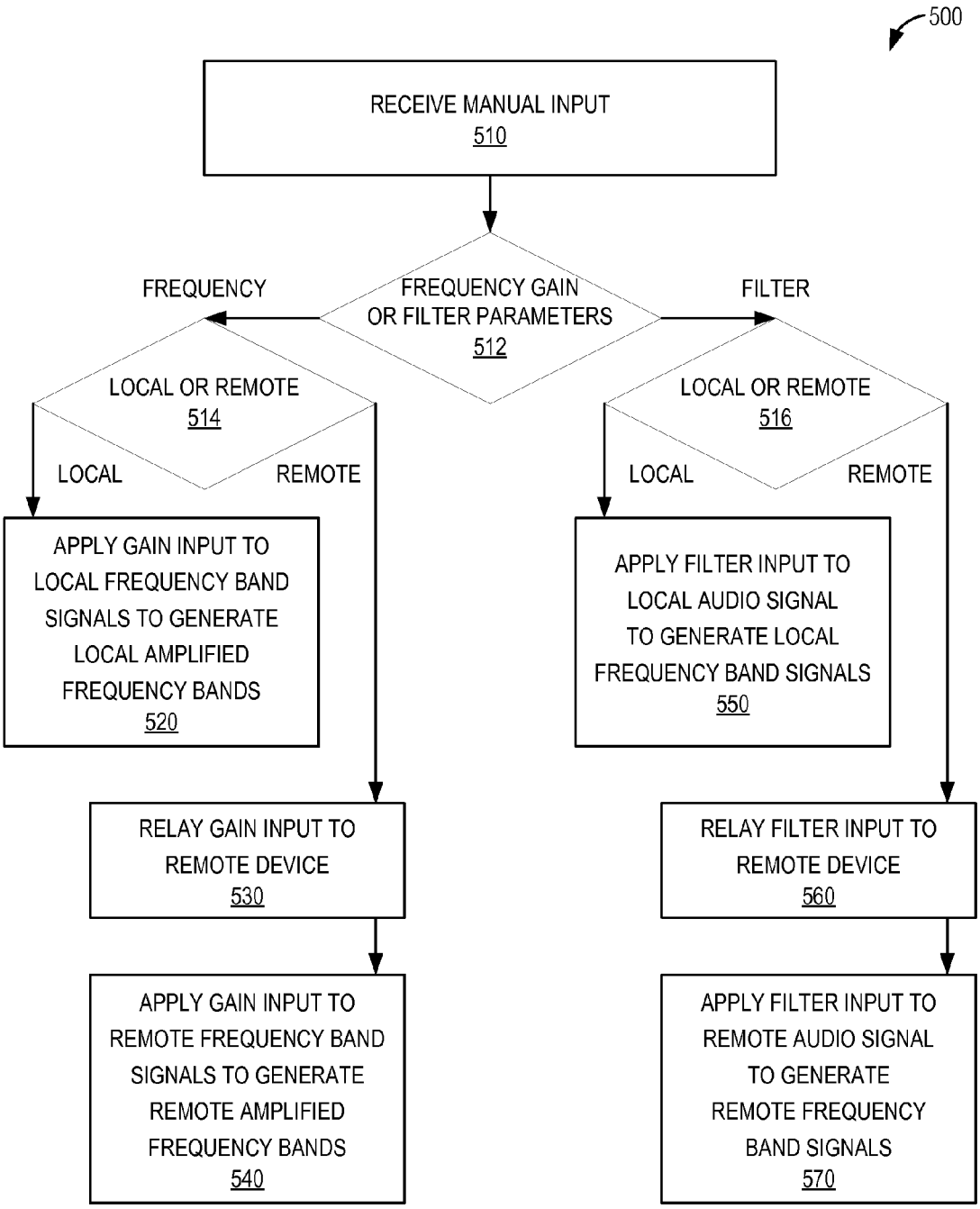
FIG. 5 shows a method of receiving and applying inputs to implement cross-modulation avoidance in remote microphones.

FIG. 5 shows a method 500 of receiving and applying inputs to implement cross-modulation avoidance in remote microphones. The local hearing assistance device may receive 510 a manual input. The manual input may be a manual frequency gain input, a manual filter parameter input, or another input. For example, a manual frequency gain input may include a manual adjustment to at least one of the local or remote frequency band gains. Method 500 may include determining the type of manual input. For example, method 500 may include determining 512 whether the input is a manual frequency gain input or a manual filter parameter input.

If the input is a manual frequency gain input, method 500 may include determining 514 whether the frequency input is intended for a local or remote device. If the input is a manual frequency gain input intended for a local device, the local device may apply 520 the local manual frequency gain input to the local frequency band signals to generate local amplified frequency bands. If the input is intended for a remote device, the manual remote frequency gain input may be relayed 530 to the remote device, and the remote device may apply 540 the remote manual frequency gain input to the remote frequency band signals to generate remote amplified frequency bands.

If the input is a manual filter parameter input, method 500 may include determining 516 whether the filter parameter input is intended for a local or remote device. The filter parameters may include multiple parameters corresponding to multiple frequency bands. For example, the filter parameters may include one or more of a pass band frequency range, a pass band attenuation profile, a stop band frequency range, and a stop band attenuation profile. If the filter parameters are intended for a local device, the local filter parameters may be used in decomposing the local audio signal. Decomposing the local audio signal may include applying 550 the local filter parameters to the local audio signal to generate the local frequency band signals. The local hearing assistance device may receive a manual filter parameter input intended for a remote device. The manual remote filter parameter input may include a manual adjustment to at least one of the remote filter parameters. The local hearing assistance device may relay 560 the manual remote filter parameter input to the remote hearing assistance device. The remote hearing assistance device may be configured to use the remote filter parameters in decomposing the remote audio signal into remote frequency band signals. For example, decomposing the remote audio signal may include applying 570 the remote filter parameters to the remote audio signal to generate remote filtered frequency bands.

Figure 6:
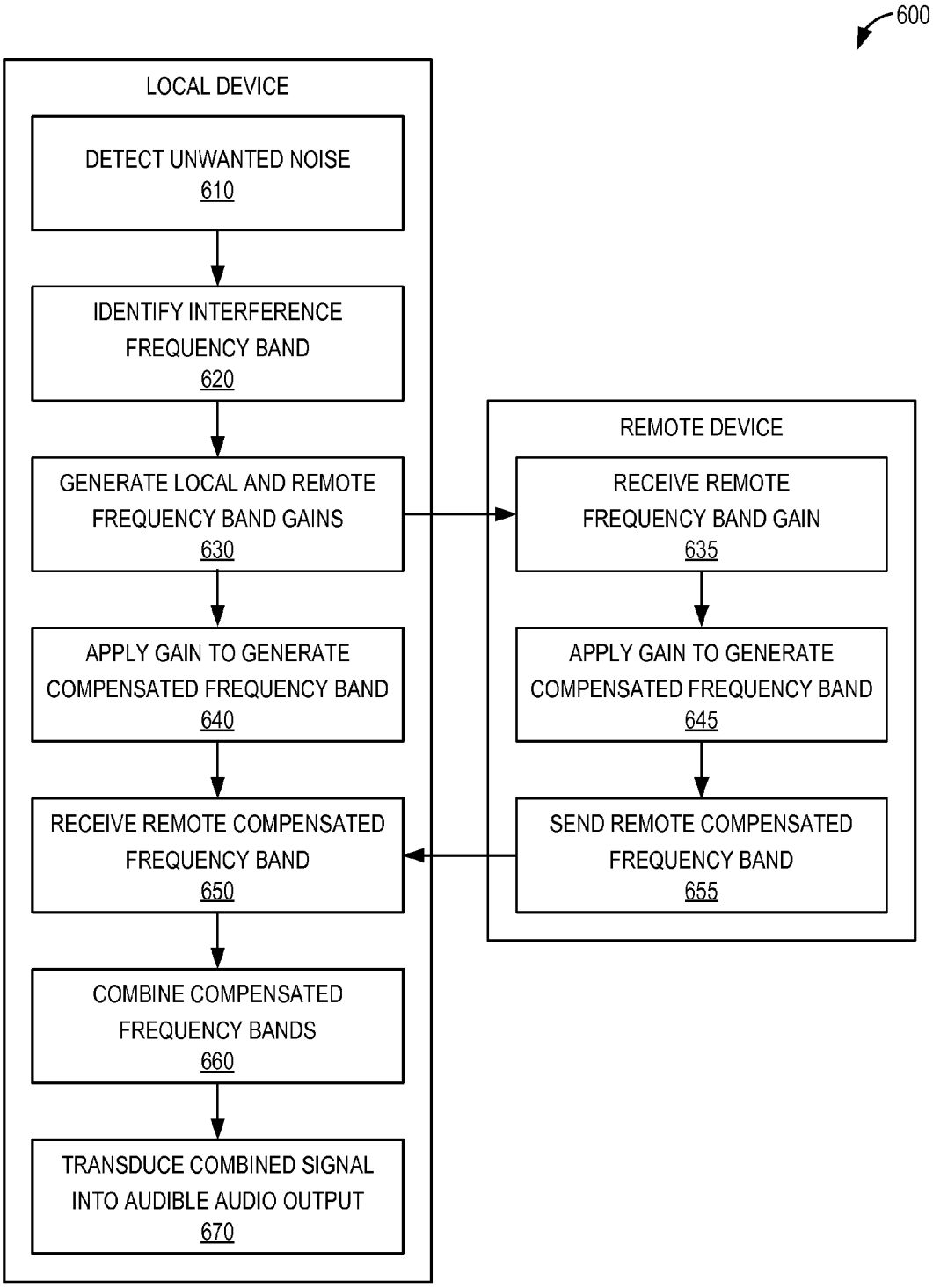
FIG. 6 shows a method of compensating for an unwanted noise using a remote microphone.

FIG. 6 shows a method 600 of compensating for an unwanted noise using a remote microphone. Method 600 will be described with respect to an embodiment that includes detecting and attenuating the unwanted noise at the local hearing assistance device, however a similar method may occur if the unwanted noise is stronger at the remote hearing assistance device than at the local hearing assistance device. In this embodiment, the local hearing assistance device may detect 610 an unwanted noise. The magnitude or duration of the unwanted noise may be transient, sustained, periodic, or a combination thereof. The local hearing assistance device may identify 620 an interference frequency band associated with the unwanted noise. The interference frequency band may be selected from between or among currently designated frequency bands. The unwanted noise may have an associated lower frequency and upper frequency, and the associated lower frequency and upper frequency may be used to identify a new frequency band associated with the unwanted noise. For example, the interference frequency band may span two or more of the currently designated frequency bands, where the unwanted noise lower frequency and upper frequency are each within a different currently designated frequency band. The interference frequency band may then be defined to include either a portion of or all of the two or more currently designated frequency bands.

In this embodiment, the local hearing assistance device may compensate for the unwanted noise by attenuating the unwanted noise at the local hearing assistance device, though other embodiments may include attenuating the unwanted noise at the remote hearing assistance device. In this embodiment, the local hearing assistance device may determine that the unwanted noise is stronger at the local hearing assistance device than at the remote hearing assistance device. The local hearing assistance device may generate 630 a local and remote unwanted noise frequency band gain corresponding to the interference frequency band. The local unwanted noise frequency band gain may be configured to reduce perception of the local unwanted noise. In contrast to the local unwanted noise frequency band gain, the remote unwanted noise frequency band gain may be configured to compensate for the reduced perception of the local unwanted noise. For example, the remote unwanted noise frequency band gain may amplify remote sounds within the remote interference frequency band to compensate for the attenuation of the local interference frequency band. The remote unwanted noise frequency band gain may be sent from the local hearing assistance device and received 635 by the remote hearing assistance device. The local unwanted noise frequency band gain may be applied 640 to the interference frequency band to generate a local compensated frequency band. Similarly, the remote hearing assistance device may apply 645 the remote unwanted noise frequency band gain to the interference frequency band to generate a remote compensated frequency band. The remote hearing assistance device may send 655 the remote compensated frequency band, and the local hearing assistance device may receive 650 the remote compensated frequency band. At the local hearing assistance device, a signal adder may be used to combine 660 the remote compensated frequency band with the local compensated frequency band to generate a combined compensated audio output signal. The local hearing assistance device may use a local speaker to transduce 670 the combined compensated audio output signal into an audible audio output.

As described above, method 600 may include detecting and attenuating the unwanted noise at the local hearing assistance device, however a similar method may occur if method 600 determines that the unwanted noise is stronger at the remote hearing assistance device than at the local hearing assistance device. In addition, a bidirectional compensation may be appropriate when the unwanted noise reaches one of the hearing assistance devices before reaching the other hearing assistance device. For example, an unwanted noise may reach the remote hearing assistance device before reaching the local hearing assistance device. As the unwanted noise reaches the remote hearing assistance device, the unwanted noise may be attenuated at the remote hearing assistance device and the local frequency band may be amplified. As the unwanted noise reaches the local hearing assistance device, the unwanted noise may be attenuated at the local hearing assistance device and the remote frequency band may be amplified and sent to the local hearing assistance device. A reversed process may be used if the unwanted noise reaches the local hearing assistance device before reaching the remote hearing assistance device.

In various embodiments, the mixing is done using the processor of the hearing assistance device. In cases where such devices are hearing aids, that processing can be done by the digital signal processor of the hearing aid or by another set of logic programmed to perform the mixing function provided herein. Other applications and processes are possible without departing from the scope of the present subject matter.

It is understood that in various embodiments, the apparatus and processes set forth herein may be embodied in digital hardware, analog hardware, and/or combinations thereof. It is also understood that in various embodiments, the apparatus and processes set forth herein may be embodied in hardware, software, firmware, and/or combinations thereof.

The present subject matter is demonstrated for hearing assistance devices, including hearing aids, including but not limited to, behind-the-ear (BTE), receiver-in-canal (RIC), and completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used with in-the-ear (ITE) and in-the-canal (ITC) devices. The present subject matter can also be used with wired or wireless ear bud devices. The present subject matter can also be used in hearing assistance devices generally, such as cochlear implant-type hearing devices and such as deep insertion devices having a transducer, such as a receiver or microphone, whether custom fitted, standard, open fitted, or occlusive fitted. It is understood that other hearing assistance devices not expressly stated herein may be used in conjunction with the present subject matter.

Example 1 includes a method for reducing the effect of hearing assistance device cross-modulation using a remote hearing assistance device, the method comprising sending a plurality of remote frequency band gains to a remote hearing assistance device, the remote hearing assistance device configured to decompose a remote audio signal into a plurality of remote frequency band signals and apply the plurality of remote frequency band gains to the plurality of remote frequency band signals to generate a plurality of remote amplified frequency bands, wherein the remote frequency band gains correspond to a remote noise environment and to a hearing loss profile of a hearing assistance user, receiving the plurality of remote amplified frequency bands at a local hearing assistance device associated with the hearing assistance user, and combining, using a signal adder, a plurality of local amplified frequency bands with the remote amplified frequency bands to generate a combined amplified audio output signal.

Example 2 includes the method of claim 1, further including receiving a remote sound signal and a local sound signal, wherein at least a portion of the local audio signal is different from at least a portion of the remote audio signal, comparing the remote sound source and the local sound source to identify a plurality of identified differences between the remote sound source and the local sound source, generating, using the plurality of identified differences, a remote speech and noise profile and a local speech and noise profile, and generating, using the remote speech and noise profile and the hearing loss profile of the hearing assistance user, the plurality of remote frequency band gains.

Example 3 includes the method of any of claims 1-2, further including generating, using the local speech and noise profile and the hearing loss profile of the hearing assistance user, a plurality of local frequency band gains, decomposing the received local audio signal into a plurality of local frequency band signals, and applying the plurality of local frequency band gains to the plurality of local frequency band signals to generate a plurality of local amplified frequency bands.

Example 4 includes the method of any of claims 1-3, further including transducing, using a remote device microphone, a remote sound source into the remote audio signal, and transducing, using a local device microphone, a local sound source into the local audio signal.

Example 5 includes the method of any of claims 1-2, further including transducing, using a local speaker, the combined amplified audio output signal into an audible audio output.

Example 6 includes the method of any of claims 1-3, wherein applying the plurality of local frequency band gains to the plurality of local frequency band signals includes applying a positive gain to a speech frequency band corresponding to speech frequencies.

Example 7 includes the method of any of claims 1-3, wherein applying the plurality of local frequency band gains to the plurality of local frequency band signals includes multiplexing the plurality of local frequency band signals through a multiplexed signal amplifier.

Example 8 includes the method of claim 1, further including applying a hearing loss characterization test to generate a plurality of hearing loss characterization results, and generating, using the plurality of hearing loss characterization results, the hearing loss profile of the hearing assistance user.

Example 9 includes the method of claim 1, further including receiving, at the local hearing assistance device, a manual remote frequency gain input, the manual remote frequency gain input including a manual adjustment to at least one of the plurality of remote frequency band gains, and relaying the manual remote frequency gain input to the remote hearing assistance device.

Example 10 includes the method of any of claims 1-3, further including receiving a plurality of local filter parameters at the local hearing assistance device, the plurality of local filter parameters corresponding to a plurality of frequency bands, wherein decomposing the local audio signal includes applying the local filter parameters to the local audio signal to generate the plurality of local frequency band signals.

Example 11 includes the method of any of claims 1-10, wherein the plurality of local filter parameters include one or more of a pass band frequency range, a pass band attenuation profile, a stop band frequency range, and a stop band attenuation profile.

Example 12 includes the method of claim 1, further including sending a plurality of remote filter parameters to the remote hearing assistance device, wherein the remote hearing assistance device is configured to decompose the remote audio signal into a plurality of remote frequency band signals by applying the remote filter parameters to the remote audio signal to generate a plurality of remote filtered frequency bands.

Example 13 includes the method of any of claims 1-12, further including receiving, at the local hearing assistance device, a manual remote filter parameter input, the manual remote filter parameter input including a manual adjustment to at least one of the plurality of remote filter parameters, and relaying the manual remote filter parameter input to the remote hearing assistance device.

Example 14 includes the method of any of claims 1-3, further including detecting, at the local hearing assistance device, a local unwanted noise in an interference frequency band, generating a local unwanted noise frequency band gain corresponding to the interference frequency band, the local unwanted noise frequency band gain configured to reduce perception of the local unwanted noise, applying the local unwanted noise frequency band gain to the interference frequency band to generate a local compensated frequency band, generating a remote unwanted noise frequency band gain corresponding to the interference frequency band, the remote unwanted noise frequency band gain configured to compensate for the reduced perception of the local unwanted noise, sending the remote unwanted noise frequency band gain to the remote hearing assistance device, the remote hearing assistance device configured to apply the remote unwanted noise frequency band gain to the interference frequency band to generate a remote compensated frequency band, receiving the remote compensated frequency band at the local hearing assistance device, and combining, using the signal adder, the remote compensated frequency band with the local compensated frequency band to generate a combined compensated audio output signal.

Example 15 includes a local hearing assistance device for reducing the effect of hearing assistance device cross-modulation using a remote hearing assistance device, the device comprising a first communications module configured to send a plurality of remote frequency band gains to a remote hearing assistance device, the remote hearing assistance device configured to decompose a remote audio signal into a plurality of remote frequency band signals and apply the plurality of remote frequency band gains to the plurality of remote frequency band signals to generate a plurality of remote amplified frequency bands, wherein the remote frequency band gains correspond to a remote noise environment and to a hearing loss profile of a hearing assistance user, receive the plurality of remote amplified frequency bands at a local hearing assistance device associated with the hearing assistance user, and a signal adder module configured to combine a plurality of local amplified frequency bands with the remote amplified frequency bands to generate a combined amplified audio output signal.

Example 16 includes the device of claim 15, further including a processor configured to receive a remote sound signal and a local sound signal, wherein at least a portion of the local audio signal is different from at least a portion of the remote audio signal, compare the remote sound source and the local sound source to identify a plurality of identified differences between the remote sound source and the local sound source, generate, using the plurality of identified differences, a remote speech and noise profile and a local speech and noise profile, generate, using the remote speech and noise profile and the hearing loss profile of the hearing assistance user, the plurality of remote frequency band gains, and generate, using the local speech and noise profile and the hearing loss profile of the hearing assistance user, a plurality of local frequency band gains.

Example 17 includes the device of any of claims 1-16, further including a filterbank configured to decompose the local audio signal into a plurality of local frequency band signals, apply the plurality of local frequency band gains to the plurality of local frequency band signals to generate a plurality of local amplified frequency bands.

Example 18 includes the device of any of claims 1-17, further including a local microphone configured to transduce a local sound source into the local audio signal.

Example 19 includes the device of any of claims 1-16, further including a local speaker configured to transduce the combined amplified audio output signal into an audible audio output.

Example 20 includes the device of any of claims 1-17, the filterbank further configured to apply a positive gain to a speech frequency band corresponding to speech frequencies.

Example 21 includes the device of any of claims 1-17, the filterbank including a multiplexed signal amplifier, the multiplexed signal amplifier configured to multiplex the plurality of local frequency band signals.

Example 22 includes the device of claim 15, the processor further configured to apply a hearing loss characterization test to generate a plurality of hearing loss characterization results, and generate, using the plurality of hearing loss characterization results, the hearing loss profile of the hearing assistance user.

Example 23 includes the device of claim 15, further including an interface module configured to receive a manual remote frequency gain input, the manual remote frequency gain input including a manual adjustment to at least one of the plurality of remote frequency band gains, wherein the first communications module is further configured to relay the manual remote frequency gain input to the remote hearing assistance device.

Example 24 includes the device of any of claims 1-23, the interface module further configured to receive a plurality of local filter parameters, the plurality of local filter parameters corresponding to a plurality of frequency bands, and the filterbank further configured to apply the local filter parameters to the local audio signal to generate the plurality of local frequency band signals.

Example 25 includes the device of any of claims 1-24, wherein the plurality of local filter parameters include one or more of a pass band frequency range, a pass band attenuation profile, a stop band frequency range, and a stop band attenuation profile.

Example 26 includes the device of claim 15, the first communications module further configured to send a plurality of remote filter parameters to the remote hearing assistance device.

Example 27 includes the device of any of claims 1-23, the interface module further configured to receive a manual remote filter parameter input, the manual remote filter parameter input including a manual adjustment to at least one of the plurality of remote filter parameters, and the first communications module further configured to relay the manual remote filter parameter input to the remote hearing assistance device.

Example 28 includes the device of any of claims 1-17, the processor further configured to detect a local unwanted noise in an interference frequency band, generate a local unwanted noise frequency band gain corresponding to the interference frequency band, the local unwanted noise frequency band gain configured to reduce perception of the local unwanted noise, and generate a remote unwanted noise frequency band gain corresponding to the interference frequency band, the remote unwanted noise frequency band gain configured to compensate for the reduced perception of the local unwanted noise.

Example 29 includes the device of any of claims 1-28, the first communications module further configured to send the remote unwanted noise frequency band gain to the remote hearing assistance device, the remote hearing assistance device configured to apply the remote unwanted noise frequency band gain to the interference frequency band to generate a remote compensated frequency band, and receive the remote compensated frequency band at the local hearing assistance device.

Example 30 includes the device of any of claims 1-29, the filterbank further configured to apply the local unwanted noise frequency band gain to the interference frequency band to generate a local compensated frequency band.

Example 31 includes the device of any of claims 1-30, the signal adder further configured to combine the remote compensated frequency band with the local compensated frequency band to generate a combined compensated audio output signal.

Example 32 includes the device of any of claims 1-23, the interface module including a second communications module, wherein the first communications module uses a first communication protocol, the second communications module uses a second communication protocol, and the first communication protocol is different from the second communication protocol.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

The preceding detailed description of the present subject matter refers to subject matter in the accompanying drawings that show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

What is claimed is:

1. A method for reducing the effect of hearing assistance device cross-modulation using a remote hearing assistance device, the method comprising:

sending a plurality of remote frequency band gains to a remote hearing assistance device, the remote hearing assistance device configured to decompose a remote audio signal into a plurality of remote frequency band signals and apply the plurality of remote frequency band gains to the plurality of remote frequency band signals to generate a plurality of remote amplified frequency bands, wherein the remote frequency band gains correspond to a remote noise environment and to a hearing loss profile of a hearing assistance user;

receiving the plurality of remote amplified frequency bands at a local hearing assistance device associated with the hearing assistance user; and combining, using a signal adder, a plurality of local amplified frequency bands with the remote amplified frequency bands to generate a combined amplified audio output signal.

2. The method of claim 1, further including:

receiving the remote audio signal and a local audio signal, wherein at least a portion of the local audio signal is different from at least a portion of the remote audio signal;

comparing the remote audio signal and the local audio signal to identify a plurality of identified differences between the remote audio signal and the local audio signal;

generating, using the plurality of identified differences, a remote speech and noise profile and a local speech and noise profile; and generating, using the remote speech and noise profile and the hearing loss profile of the hearing assistance user, the plurality of remote frequency band gains.

3. The method of claim 2, further including:

generating, using the local speech and noise profile and the hearing loss profile of the hearing assistance user, a plurality of local frequency band gains;

decomposing the received local audio signal into a plurality of local frequency band signals; and applying the plurality of local frequency band gains to the plurality of local frequency band signals to generate a plurality of local amplified frequency bands.

4. The method of claim 3, further including:

transducing, using a remote device microphone, a remote sound source into the remote audio signal; and transducing, using a local device microphone, a local sound source into the local audio signal.

5. The method of claim 3, wherein applying the plurality of local frequency band gains to the plurality of local frequency band signals includes applying a positive gain to a speech frequency band corresponding to speech frequencies.

6. The method of claim 3, wherein applying the plurality of local frequency band gains to the plurality of local frequency band signals includes multiplexing the plurality of local frequency band signals through a multiplexed signal amplifier.

7. The method of claim 3, further including:

receiving a plurality of local filter parameters at the local hearing assistance device, the plurality of local filter parameters corresponding to a plurality of frequency bands;

wherein decomposing the local audio signal includes applying the local filter parameters to the local audio signal to generate the plurality of local frequency band signals.

8. The method of claim 7, wherein the plurality of local filter parameters include one or more of a pass band frequency range, a pass band attenuation profile, a stop band frequency range, and a stop band attenuation profile.

9. The method of claim 3, further including detecting, at the local hearing assistance device, a local unwanted noise in an interference frequency band;

generating a local unwanted noise frequency band gain corresponding to the interference frequency band, the local unwanted noise frequency band gain configured to reduce perception of the local unwanted noise;

applying the local unwanted noise frequency band gain to the interference frequency band to generate a local compensated frequency band;

generating a remote unwanted noise frequency band gain corresponding to the interference frequency band, the remote unwanted noise frequency band gain configured to compensate for the reduced perception of the local unwanted noise;

sending the remote unwanted noise frequency band gain to the remote hearing assistance device, the remote hearing assistance device configured to apply the remote unwanted noise frequency band gain to the interference frequency band to generate a remote compensated frequency band;

receiving the remote compensated frequency band at the local hearing assistance device; and combining, using the signal adder, the remote compensated frequency band with the local compensated frequency band to generate a combined compensated audio output signal.

10. The method of claim 2, further including transducing, using a local speaker, the combined amplified audio output signal into an audible audio output.

11. The method of claim 1, further including:

applying a hearing loss characterization test to generate a plurality of hearing loss characterization results; and generating, using the plurality of hearing loss characterization results, the hearing loss profile of the hearing assistance user.

12. The method of claim 1, further including:

receiving, at the local hearing assistance device, a manual remote frequency gain input, the manual remote frequency gain input including a manual adjustment to at least one of the plurality of remote frequency band gains; and relaying the manual remote frequency gain input to the remote hearing assistance device.

13. The method of claim 1, further including:

sending a plurality of remote filter parameters to the remote hearing assistance device;

wherein the remote hearing assistance device is configured to decompose the remote audio signal into a plurality of remote frequency band signals by applying the remote filter parameters to the remote audio signal to generate a plurality of remote filtered frequency bands.

14. The method of claim 13, further including:

receiving, at the local hearing assistance device, a manual remote filter parameter input, the manual remote filter parameter input including a manual adjustment to at least one of the plurality of remote filter parameters; and relaying the manual remote filter parameter input to the remote hearing assistance device.

15. A local hearing assistance device for reducing the effect of hearing assistance device cross-modulation using a remote hearing assistance device, the device comprising:

a first communications module configured to:

send a plurality of remote frequency band gains to a remote hearing assistance device, the remote hearing assistance device configured to decompose a remote audio signal into a plurality of remote frequency band signals and apply the plurality of remote frequency band gains to the plurality of remote frequency band signals to generate a plurality of remote amplified frequency bands, wherein the remote frequency band gains correspond to a remote noise environment and to a hearing loss profile of a hearing assistance user;

receive the plurality of remote amplified frequency bands at a local hearing assistance device associated with the hearing assistance user; and a signal adder module configured to combine a plurality of local amplified frequency bands with the remote amplified frequency bands to generate a combined amplified audio output signal.

16. The device of claim 15, further including a processor configured to:

receive the remote audio signal and a local audio signal, wherein at least a portion of the local audio signal is different from at least a portion of the remote audio signal;

compare the remote audio signal and the local audio signal to identify a plurality of identified differences between the remote audio signal and the local audio signal;

generate, using the plurality of identified differences, a remote speech and noise profile and a local speech and noise profile;

generate, using the remote speech and noise profile and the hearing loss profile of the hearing assistance user, the plurality of remote frequency band gains; and generate, using the local speech and noise profile and the hearing loss profile of the hearing assistance user, a plurality of local frequency band gains.

17. The device of claim 16, further including a filterbank configured to:

decompose the local audio signal into a plurality of local frequency band signals;

apply the plurality of local frequency band gains to the plurality of local frequency band signals to generate a plurality of local amplified frequency bands.

18. The device of claim 17, further including a local microphone configured to transduce a local sound source into the local audio signal.

19. The device of claim 17, the filterbank further configured to apply a positive gain to a speech frequency band corresponding to speech frequencies.

20. The device of claim 17, the filterbank including a multiplexed signal amplifier, the multiplexed signal amplifier configured to multiplex the plurality of local frequency band signals.

21. The device of claim 17, further including an interface module configured to receive a manual remote frequency gain input, the manual remote frequency gain input including a manual adjustment to at least one of the plurality of remote frequency band gains;

wherein the first communications module is further configured to relay the manual remote frequency gain input to the remote hearing assistance device.

22. The device of claim 21, the interface module further configured to receive a plurality of local filter parameters, the plurality of local filter parameters corresponding to a plurality of frequency bands; and the filterbank further configured to apply the local filter parameters to the local audio signal to generate the plurality of local frequency band signals.

23. The device of claim 22, wherein the plurality of local filter parameters include one or more of a pass band frequency range, a pass band attenuation profile, a stop band frequency range, and a stop band attenuation profile.

24. The device of claim 21, the interface module further configured to receive a manual remote filter parameter input, the manual remote filter parameter input including a manual adjustment to at least one of the plurality of remote filter parameters; and the first communications module further configured to relay the manual remote filter parameter input to the remote hearing assistance device.

25. The device of claim 21, the interface module including a second communications module, wherein:

the first communications module uses a first communication protocol;

the second communications module uses a second communication protocol; and the first communication protocol is different from the second communication protocol.

26. The device of claim 17, the processor further configured to:

detect a local unwanted noise in an interference frequency band;

generate a local unwanted noise frequency band gain corresponding to the interference frequency band, the local unwanted noise frequency band gain configured to reduce perception of the local unwanted noise; and generate a remote unwanted noise frequency band gain corresponding to the interference frequency band, the remote unwanted noise frequency band gain configured to compensate for the reduced perception of the local unwanted noise.

27. The device of claim 26, the first communications module further configured to:

send the remote unwanted noise frequency band gain to the remote hearing assistance device, the remote hearing assistance device configured to apply the remote unwanted noise frequency band gain to the interference frequency band to generate a remote compensated frequency band; and receive the remote compensated frequency band at the local hearing assistance device.

28. The device of claim 27, the filterbank further configured to apply the local unwanted noise frequency band gain to the interference frequency band to generate a local compensated frequency band.

29. The device of claim 28, the signal adder further configured to combine the remote compensated frequency band with the local compensated frequency band to generate a combined compensated audio output signal.

30. The device of claim 16, further including a local speaker configured to transduce the combined amplified audio output signal into an audible audio output.

31. The device of claim 15, the processor further configured to:

apply a hearing loss characterization test to generate a plurality of hearing loss characterization results; and generate, using the plurality of hearing loss characterization results, the hearing loss profile of the hearing assistance user.

32. The device of claim 15, the first communications module further configured to send a plurality of remote filter parameters to the remote hearing assistance device.

* * * * *